US007168784B2

(12) United States Patent
Donovan et al.

(10) Patent No.: US 7,168,784 B2
(45) Date of Patent: Jan. 30, 2007

(54) FORMATION OF IMAGES

(75) Inventors: David Donovan, San Diego, CA (US); Kevin R. Hudson, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 326 days.

(21) Appl. No.: 10/814,724

(22) Filed: Mar. 30, 2004

(65) Prior Publication Data

US 2005/0219314 A1 Oct. 6, 2005

(51) Int. Cl.
*B41J 2/15* (2006.01)

(52) U.S. Cl. ..... 347/41; 347/15

(58) Field of Classification Search ..... 347/16, 347/15, 41, 43
See application file for complete search history.

(56) References Cited

U.S. PATENT DOCUMENTS

| | | | | |
|---|---|---|---|---|
| 4,999,629 | A | 3/1991 | Katsuta | |
| 5,270,837 | A | 12/1993 | Chen et al. | |
| 5,625,460 | A | 4/1997 | Tai | |
| 5,714,990 | A | 2/1998 | Courtney | |
| 5,768,403 | A | 6/1998 | Suzuki et al. | |
| 5,946,451 | A | 8/1999 | Soker | |
| 5,949,964 | A | 9/1999 | Clouthier et al. | |
| 5,992,962 | A | 11/1999 | Yen et al. | |
| 6,302,522 | B1 | 10/2001 | Rumph et al. | |
| 6,328,403 | B1 | 12/2001 | Iwasaki et al. | |
| 6,425,653 | B1 | 7/2002 | Bloomberg | |
| 6,454,389 | B1 | 9/2002 | Couwenhoven et al. | |
| 6,481,818 | B1 | 11/2002 | Cox et al. | |
| 6,532,026 | B2 | 3/2003 | Takahashi et al. | |
| 6,543,871 | B1 * | 4/2003 | Rosen et al. | 347/15 |
| 6,565,192 | B1 | 5/2003 | Vinals et al. | |
| 6,597,472 | B1 | 7/2003 | Suzuki et al. | |
| 2002/0060805 | A1 | 5/2002 | Tomita | |
| 2003/0007024 | A1 * | 1/2003 | Fujimori | 347/15 |
| 2003/0063140 | A1 | 4/2003 | Nguyen et al. | |
| 2004/0021732 | A1 | 2/2004 | Bergen | |

FOREIGN PATENT DOCUMENTS

| | | |
|---|---|---|
| EP | 0863479 | 9/1998 |

OTHER PUBLICATIONS

European Search Report dated Aug. 10, 2005.

* cited by examiner

*Primary Examiner*—Lamson Nguyen

(57) ABSTRACT

A method of forming images including obtaining image data defining an image portion and including data elements defining a first subset and a second subset of areas of the image portion having one or more lesser amounts and one or more greater amounts, respectively, of a colorant, and forming the image portion by placement of the colorant onto a medium during a set of overlapping passes so that the first subset of the areas is formed by at least one of (a) a subset of the overlapping passes and (b) a predefined subset of a plurality of structures available for placing the colorant.

36 Claims, 3 Drawing Sheets

FORMATION OF IMAGES

BACKGROUND

Printers may create a portion of a printed image on a print medium by firing ink droplets of a particular color at the print medium. These ink droplets may be fired from a single printhead or from redundant printheads, among others, to create areas of the image portion. The areas may be created using ink placement during one or more printhead passes over the print medium.

For some areas of an image portion, multiple printhead passes or redundant printheads may be used to form a higher density of the ink droplets. Otherwise, print quality may be affected adversely by exceeding, for example, the capacity of a printhead to deliver ink effectively in a single pass. However, the use of multiple passes or redundant printheads for creating these areas may produce substantial registration errors among different passes or printheads. Such registration errors may degrade a printed image by creating blurriness and/or graininess in the image.

DETAILED DESCRIPTION

Figure 1:
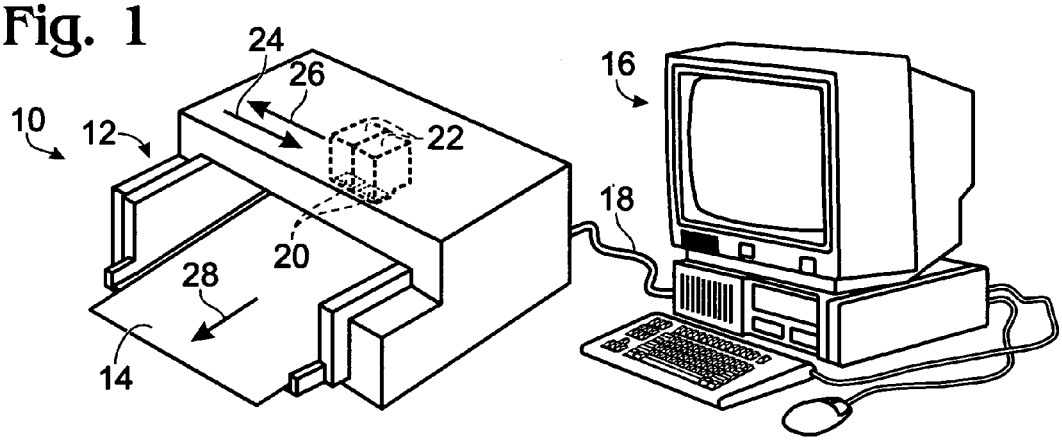
FIG. 1 is a view of an embodiment of a system for forming images, including image highlight regions, in accordance with an embodiment of the present teachings.

The present teachings provide systems, including apparatus and methods, for forming images, such as images including image highlight regions. The systems may obtain image data defining an image portion to be formed, such as an image portion to be formed with a colorant (or a plurality of colorants) and corresponding to a swath of printed output. The image data may include a set of data elements corresponding to areas of the image portion and defining an amount (and/or density) of the colorant for each area. In particular, the data elements may define a first subset of the areas having one or more lesser (nonzero) amounts (and/or densities) of the colorant. The first subset of the areas may be considered to be highlight regions of the image portion. The data elements also may define a second subset of the areas having one or more greater amounts (and/or densities) of the colorant. Each data element may have a data value corresponding to a particular one of the lesser or greater amounts (and/or densities) of the colorant for a corresponding area of the image portion. In some examples, the data values may be selected from a set of permissible values, such as a set of two or more permissible values, for example, a contone set of values or a halftone set of values, among others.

The systems may distribute the image data to a set of pass assignments corresponding to a set of overlapping passes. Distribution may be performed so that the first subset of the areas (the highlight regions) will be formed completely by a subset of the overlapping passes and/or by a subset of structures (such as printheads and/or nozzles, among others) that are available to place the colorant for the overlapping passes. In some examples, distribution of the image data may be performed by applying one or more predefined masks to the image data. The predefined masks may be configured and applied so that a subset of the data elements, with data values selected from a subset of the permissible values, are assigned to a subset of the pass assignments and/or to particular positions within the pass assignments. These particular positions may correspond to a subset of the structures (such as nozzles) available to place the colorant. In some examples, distribution of the image data may be performed by comparing data values (such as contone data values) to a threshold(s) and distributing data elements to pass assignments and/or particular positions within pass assignments based on this comparison. In any case, the colorant then may be placed onto a medium to form the image portion with the set of overlapping passes corresponding to the pass assignments.

The highlight regions of an image, because of a lower amount/density of colorant dots, may be more sensitive to problems related to image quality. These problems may include registration errors, noticeability of individual dots, and/or patterning created by the arrangement of dots in relation to unprinted areas. In addition, these problems may be more pronounced with use of multiple passes, use of multiple printheads, and/or use of particular regions of a printhead, among others. The highlight regions thus may be formed by colorant placement from a subset of a set of overlapping passes performed by one or more printheads, and/or by a subset of printheads (and/or nozzles thereof) available to place the colorant. Accordingly, by using fewer passes and/or fewer image forming structures (such as printheads and/or nozzles, among others) to form highlight regions, and in a particular embodiment by using one pass of one printhead to form these regions within a swath of printed output, overall image quality may be improved.

The image forming systems may include apparatus configured to place visible image elements (such as dots) on a medium. The visible image elements may be formed with one or more colorants, such as inks, dyes, and/or other fluid or solid coloring agents. Colorants may impart any color (or colors) and/or color change(s), including black and/or white, to areas of a medium. Alternatively, or in addition, the visible image elements may be formed with one or more types of lights (colorant thus taking the form of light of different wavelengths), for example, by light projection or medium excitation, among others. Accordingly, the image forming systems may include a printing apparatus or printer (such as an inkjet printer, a laser printer, a plotter, or the like), a projector, a television, and/or a display, among others.

FIG. 1 shows an example of a system 10 for forming images including image highlight regions. System 10 may include an image forming apparatus, such as a printer 12, configured to form images on (and/or in) medium 14. System 10 also may include a computing device 16 in communication, shown at 18, with the printer. The computing device may be configured to send image data in any suitable form to the image forming apparatus.

The image forming apparatus may include one or more image forming structures or devices, such as one or more printheads 20. Each printhead may be any device from which colorant(s) is dispensed to a print medium. In the present illustration, printheads 20 are included in colorant cartridges 22 serving as colorant reservoirs. In other embodiments, colorant reservoirs may be disposed in a spaced relation to their printheads, that is, off-axis.

The printhead(s) may be stationary or may move relative to the print medium. In the present illustration, the printheads are configured to reciprocate, in opposing directions 24, 26, along an x-axis defined by the printer. Each printhead may perform passes during travel in each of the opposing directions (bi-directional printing) and/or during travel in only one of the directions (uni-directional printing). Accordingly, the term "pass," as used herein, refers to one transit or passage of one image forming device across a region adjacent a medium, during which the image forming device forms image elements on, in, and/or adjacent the medium, for example, by delivery of a colorant from the device during the passage. The transit may be performed by movement of the image forming device relative to the medium and/or movement of the medium relative to the image forming device. With redundant image forming devices, each image forming device can perform (or not perform) a distinct pass as it travels adjacent a region of the medium. For example, two redundant image forming devices traveling in tandem can perform a total of zero, one, or two passes as they travel once over a region of the medium.

Figure 3:
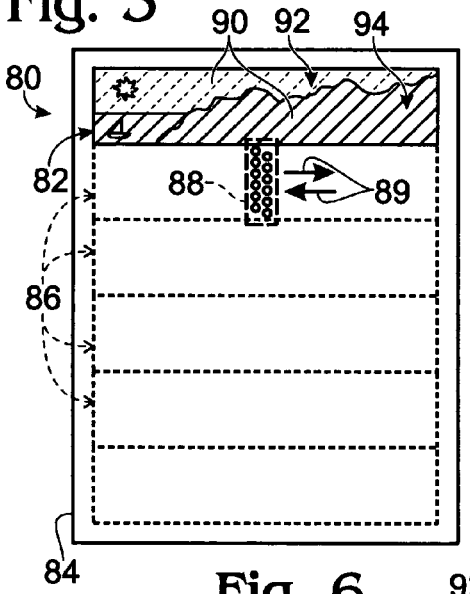
FIG. 3 is a plan view of printed output created by formation of an example image portion with reduced registration errors on a print medium using multiple passes of one printhead, in accordance with an embodiment of the present teachings.

The printer may be configured to move the print medium along a y-axis 28, so that the printheads (whether movable along the x-axis or stationary) can access different segments of the print medium to form swaths of printed output (see FIG. 3). Alternatively, or in addition, the printer may be configured to move printheads along the y-axis as the print medium remains stationary.

Figure 2:
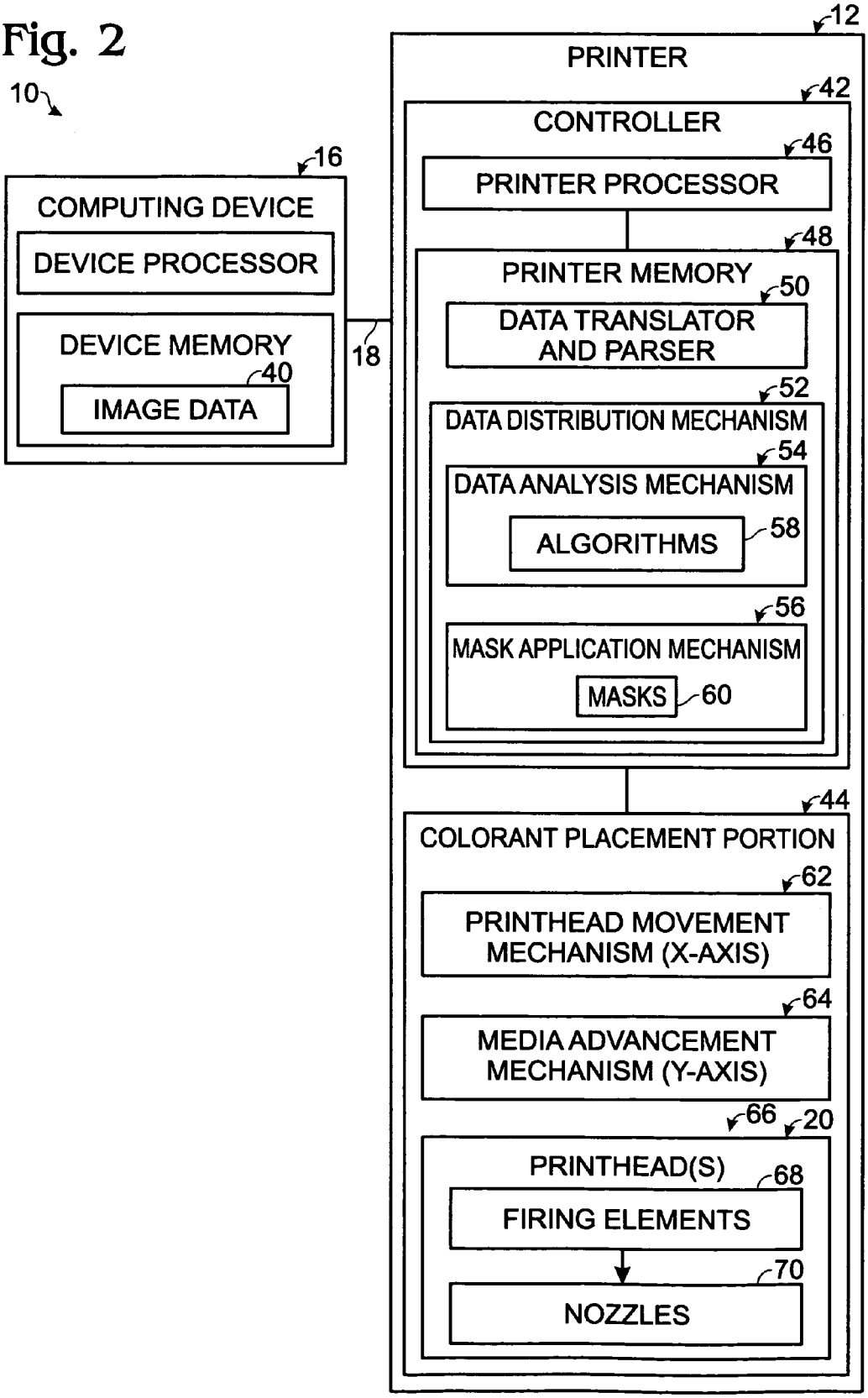
FIG. 2 is a schematic view of the embodiment of the system of FIG. 1, in accordance with an embodiment of the present teachings.

FIG. 2 shows a schematic view of system 10. Computing device 16 may be configured to send image (or print) data 40 defining an image portion to printer 12. Alternatively, or in addition, the computing device may be configured to parse data into sets of image data corresponding to individual output swaths, analyze the image data to identify areas of lesser and greater colorant amounts in the corresponding image portion, and/or distribute the image data so that subsets of data elements are used to form image elements during particular passes, among others. However, in the present illustration, printer 12 is configured to perform these and other tasks that may be assigned alternatively, or in addition, to computing device 16.

Printer 12 may include a controller 42 and a colorant placement portion 44. Controller 42 may be configured to receive image data 40 from computing device 16 and process the image data into printing instructions for the colorant placement portion. As part of this processing, the controller may distribute image data to pass assignments so that highlight regions of an image portion are printed by a subset of a set of overlapping passes used for forming the image portion and/or by a subset of printing structures available to place the colorant. Colorant placement portion 44 may be configured to dispense colorant positionally during passes selected by the printer controller.

Controller 42 may include a printer processor 46 and printer memory 48. The printer processor may be configured to perform manipulation of image data received from the computing device and/or from the printer memory, including logic and/or arithmetic operations, among others. Processing of the image data may be performed based on processing instructions for the image data. Such processing instructions may be contained in printer memory 48 (such as hardware, firmware, and/or software, among others) and may include a data translator and parser 50, and a data distribution mechanism 52, among others.

Data translator and parser 50 may be any mechanism(s) for translating the image data into a different form(s) and/or parsing the image data into instructions for individual printed swaths (see FIG. 3). Data translation (or rendering) may include conversion of the image data into a page description language, conversion of contone data into a more quantized form (such as multi-level halftone data or binary halftone data; see FIG. 7), and/or conversion of image data to a different resolution, among others.

Data distribution mechanism 52 may be any mechanism for distributing the image data to a set of pass assignments. Pass assignments, as used herein, are portions of the image data designated to instruct colorant placement during corresponding passes. The portions of the image data, when summed over the pass assignments, may at least substantially equal the image data. The data distribution mechanism may include a data analysis mechanism 54 and/or a mask application mechanism 56, among others.

Data analysis mechanism 54 may be any mechanism for distribution of the image data to pass assignments based on the image data itself. Accordingly, the data analysis mechanism may be configured to examine the image data to identify data elements corresponding to image areas with lesser and/or greater amounts of a colorant. The data analysis mechanism may analyze data values of individual data elements or the data values of sets of data elements, such as pixel neighborhoods. This data analysis, and distribution of the image data based on this analysis, may be performed, for example, with one or more algorithms 58 configured for this purpose. Algorithm 58 may operate to distribute the image data to pass assignments without predefined masks. The algorithm may distribute the image data to pass assignments, by directly selecting subsets of the image data, without application of a distinct mask. For example, the algorithm may include a rule which causes specified image data levels (values) or identified areas of image data to be assigned to a particular subset of pass assignments. Alternatively, masks may be created based on the analysis of the image data, and then applied to the image data. Exemplary data analysis and data distribution based on this analysis are described below in relation to FIG. 7.

Mask application mechanism 56 may be used as an alternative to, or in addition to, data analysis mechanism 54. The mask application mechanism 54 may be any mechanism for masking image data 40 using one or more predefined masks 60. A mask, as used herein, is a spatial pattern that is logically compared to image data to assign a portion of the image data to a particular pass assignment for implementation during a corresponding pass. Masks may be designed as a complementary set, such that among a set of masks, all image data may be distributed to a set of pass assignments and thus properly printed during a corresponding set of passes. The mask may be predefined, that is, constructed independently of the content of the image data, so that the highlight regions are formed by a particular subset of overlapping passes and/or by a subset of available colorant placement structures. The mask application mechanism may distribute the image data to pass assignments corresponding to a plurality of overlapping passes that create an output swath. As part of this masking process, some data values may be set to a null value (generally zero) to "mask" the corresponding data element so that this data element is not implemented in a particular pass (or passes).

Colorant placement portion 44 may include a printhead movement mechanism 62, a media advancement mechanism 64, and a set of image forming structures 66, such as printheads 20 and/or nozzles. Printhead movement mechanism 62 may cause the printhead to reciprocate, as illustrated in FIG. 1. Alternatively, or in addition, the printhead movement mechanism may move the printhead in any other suitable direction(s), including two or three orthogonal directions, among others, or may be omitted from the printer. Media advancement mechanism 64 may move print media along an axis orthogonal to the axis defined by the printhead movement mechanism. In some embodiments, the printhead movement mechanism may perform the function of the media advancement mechanism by moving orthogonally. Alternatively, or in addition, the media advancement mechanism may move the media in orthogonal directions.

Image forming structures 66 may be any structures from which a particular colorant may be placed. Accordingly, the structures may be one or more printheads 20 configured to deliver the colorant. In some examples, a particular colorant may be delivered from two or more substantially redundant printheads configured to access overlapping and/or identical sections of a print medium (see FIG. 6). Printhead(s) may include firing elements 68, such as heater elements or piezoelectric elements. The firing elements may operate to expel colorant droplets from any array of image forming structures, such as nozzles 70, and onto a print medium. In some examples, image highlight regions may be formed by a subset of the nozzles, such as nozzles with a particular position and/or configuration within a printhead. The particular position may be, for example, a central set of rows of nozzles within an array of nozzles (to avoid printhead end effects), nozzles restricted to a subset of columns within an array of nozzles, a subset of nozzles having a distinct orifice size and/or associated with a distinct type of firing element, and/or the like.

FIG. 3 shows printed output 80 created by formation of an image portion 82 with reduced registration errors on a print medium 84. The image portion may be any suitable portion of a computer generated image (text, graphics, art, etc.), a photograph, and/or a digitized (or scanned) image (such as a picture, a drawing, a handwritten or printed document, etc.), among others. In some examples, the image portion is a single-colorant portion of a multi-colorant image or may be a multi-colorant image portion. The print medium may be a sheet medium, such as paper, cardboard, plastic, fabric, metal, and/or glass, among others.

The image portion may correspond to one of a set of output swaths 86, or to a portion(s) of an output swath(s), among others. Each output swath may be a segment accessed by travel of a printhead(s) 88 (shown in phantom outline) across a region adjacent the print medium. The swath may extend across any suitable region of the print medium. For example, the swath may extend at least substantially (or completely) across the print medium, that is, to positions adjacent opposing edges of the print medium, or may extend any suitable portion thereof. The output swaths may be adjoining, but substantially nonoverlapping, as shown here. Alternatively, the output swaths may be overlapping, for example, produced by partially overlapping passes of the printhead. Each lighter area within each output swath (and thus of each image portion) may be formed with a subset (one or more) of a set of overlapping passes 89 of the printhead. Overlapping passes, as used herein, access overlapping regions of a medium. However, colorant may be delivered to different areas within the overlapping regions by the overlapping passes, so that the overlapping passes form interspersed (overlapping) sub-patterns of dots. The overlapping regions may be partially or completely overlapping. Accordingly, overlapping passes may be completely overlapping or partially overlapping. For a set of overlapping passes, as used herein, each pass of the set overlaps every other pass of the set.

The image portion may be created with one colorant 90 or with a plurality of different colorants. The amounts (and densities) of the colorant in regions of image portion 82 are indicated in the present illustration according to the continuity (and weight) of hatch lines. Image portion 82 may include one or more lighter regions (or highlight regions) 92 (dashed lines) formed by lighter image areas 93 (a first subset of the image areas) with lesser amounts (and/or densities) of the colorant. Image portion 82 also may include one or more darker regions 94 (solid lines) formed by darker image areas 95 (a second subset of the image areas) with greater amounts (and/or densities) of the colorant. The lighter and darker regions each may have a range of colorant amounts defined for individual areas by the values of corresponding data elements (see below). Accordingly, the lesser amount and the greater amount of a colorant each may correspond to one amount, or, more generally, to a one or more smaller amounts and one or more larger amounts, respectively, of the colorant.

Each region may have any suitable size and position. In some examples, each of the regions (and their component areas) may be disposed in a single output swath. Accordingly, lighter and darker areas may be interspersed. Alternatively, the regions may be disposed in a plurality of output swaths, with lighter and darker regions disposed in the same or different swaths. Each area of a region may correspond to a single data element or to a plurality of adjacent data elements, such as a set of bi-level halftone data elements. Accordingly, lighter and darker areas may be defined based on each individual data element or based on a set of data elements (for example, by examining proximity, density, neighborhoods, etc).

Figure 4:
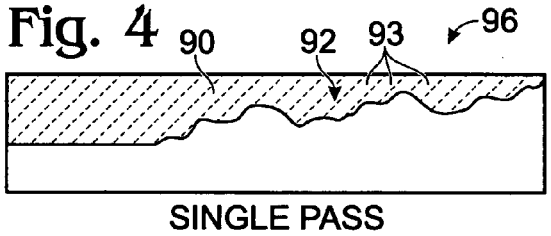
FIG. 4 is a view of a region of the example image portion of FIG. 3 composed of lighter areas having lesser amounts of a colorant and produced by placement of the colorant using only one pass of one printhead to reduce registration errors, in accordance with an embodiment of the present teachings.

FIG. 4 shows lighter region 92 produced by placement of colorant 90 during a single printhead pass 96 across a region adjacent the print medium to reduce registration errors within the lighter region. In some examples, the subset of lighter areas 93 of the lighter region 92 may be created using fewer printhead passes (and/or fewer colorant placement structures) than to create the subset of darker areas 95 of the darker region 94.

Figure 5:
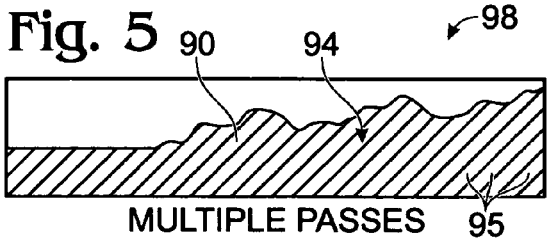
FIG. 5 is a view of another region of the example image portion of FIG. 3 composed of darker areas having greater amounts of the colorant and produced by placement of the colorant using multiple passes of one printhead, in accordance with an embodiment of the present teachings.

FIG. 5 shows darker region 94 produced by placement of colorant 90 during multiple printhead passes 98 across the print medium. One (or more) of the multiple passes may be the same pass(es) used to create lighter region 92 or areas thereof. Accordingly, a portion of darker region 94 may be created concurrently with lighter region 92. Darker region 94 may have no reduction in registration errors relative to pass assignment without identification of registration-sensitive areas. However, such registration errors may be less noticeable (and thus less of a problem) due to the higher density of colorant dots.

Figure 6:
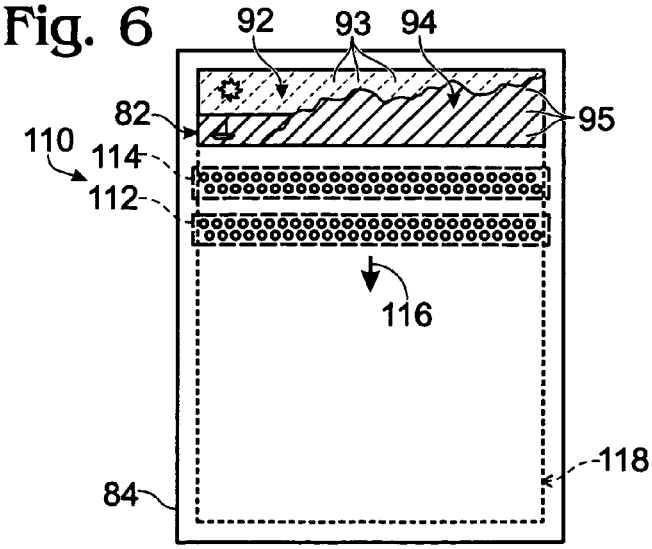
FIG. 6 is a plan view of printed output created by formation of an example image portion with reduced registration errors on a print medium using only one pass of a set of redundant printheads, in accordance with an embodiment of the present teachings.

FIG. 6 shows printed output 110 created by formation of image portion 82 with reduced registration errors on a print medium 84 during a single pass of two or more redundant printheads, such as printheads 112, 114. Redundant printheads 112, 114 may be configured to deliver the same or a similar colorant to overlapping (or the same) regions of print medium 84 as these printheads travel along the print medium, shown at 116. Alternatively, the print medium may move as the printheads remain stationary. In the present illustration, each of printheads 112, 114 define an output swath 118 corresponding to the set of output swaths 86 of FIG. 3 and to the entire printed area. Similar to printed output 80 of FIG. 3, lighter areas 93 may be printed during a single pass (one pass of one of the printheads, such as first printhead 112). Also, darker areas 95 may be printed during multiple printhead passes, for example, by a single pass of each of printheads 112, 114.

Figure 7:
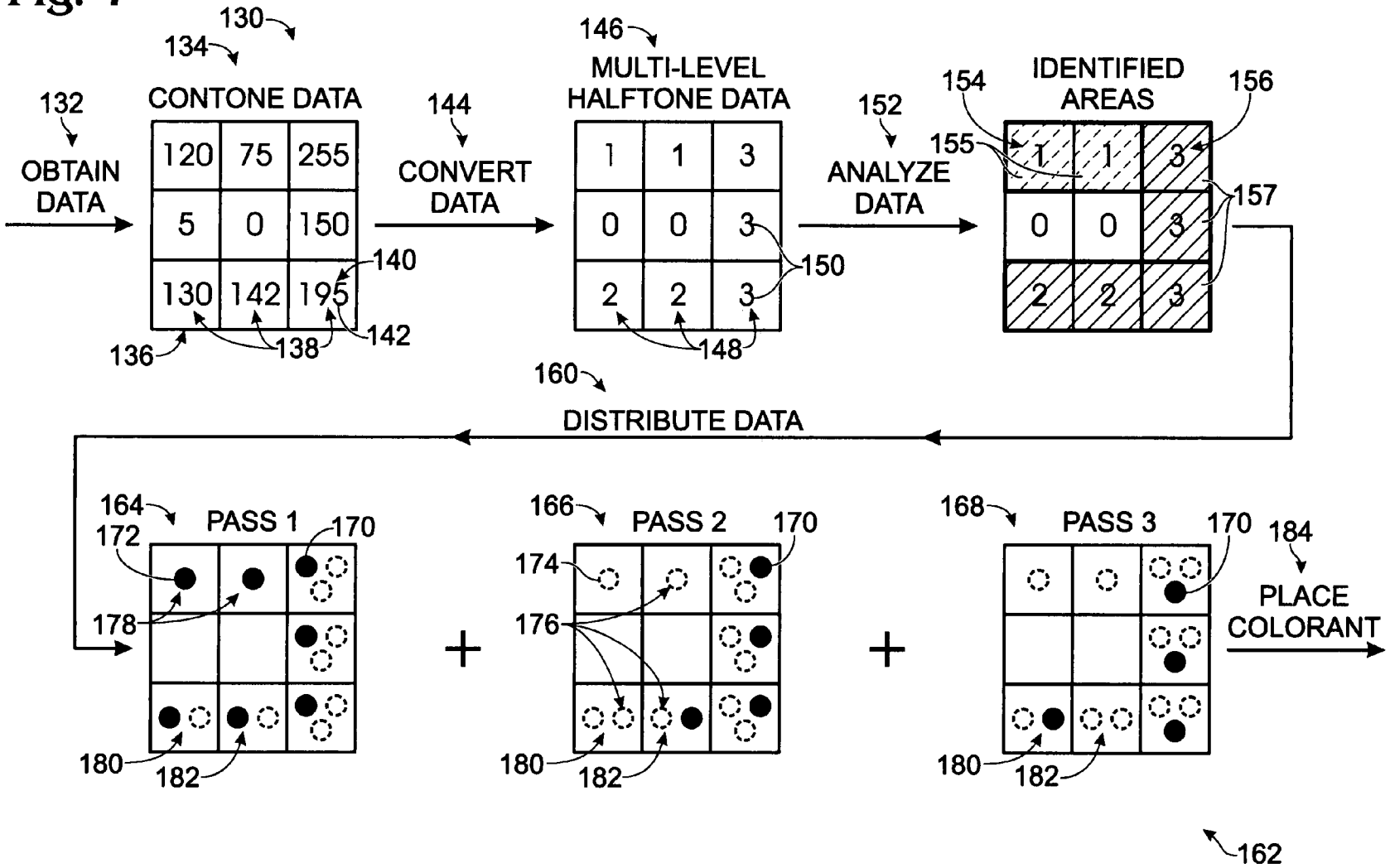
FIG. 7 is a flowchart illustrating an embodiment of a method of forming images, including image highlight regions, in accordance with an embodiment of the present teachings.

FIG. 7 shows a flowchart illustrating a method 130 of forming images including image highlight regions. The method may be performed by any suitable image forming apparatus, as described above, alone or in combination with a computing device. The operations of the method shown may be performed in any suitable combination (i.e., one or more may be omitted) and in any suitable order.

Method 130 may include an operation, shown at 132, of obtaining image data 134 defining a portion of an image. The operation of obtaining may include receiving the image data from a remote location, such as from a separate computing device and/or based on inputs from a person, among others. Image data 134 may be in any suitable format, such as a matrix 136 of contone data elements 138. A very small matrix of image data is shown here to simplify the presentation. However, the matrix may be of any suitable size. Each contone data element may correspond to an area within an image portion, for example, based on a row and column position 140 within the matrix of data elements. Each contone data element also may have a data value 142, such as a numerical value, represented here by an integer between zero and two-hundred and fifty-five, so the data value in this example may be one of two-hundred and fifty-six data values. More generally, a data element may have a data value selected from a set of at least two or more permissible values, and a contone data element may have a data value selected from a set of at least sixteen or more permissible values (such as consecutive integers). The data value of each data element may define an amount (and/or a density) of a colorant for an area of the image portion.

Method 130 may include an operation, shown at 144, of converting the image data (rendering the data) to another form, such as multi-level halftone data 146 of data elements 148. Multi-level halftone data, as used herein, has data elements with data values selected from a set of three or more permissible values and generally from a smaller set than a contone set of permissible values. Bi-level halftone data has data elements with data values selected from a set of two permissible values, generally zero and one.

The data values 150 of the data elements of the multi-level halftone data may be selected from a smaller set of permissible values than for the contone values, producing a greater quantization of the data. For example, in the present illustration, data conversion converts a first set of data elements, each having one of two-hundred and fifty-six permissible values into a second set of data elements having one of four permissible values, the integers zero through three. In the present example, contone values of 0–63 are set to "0", values of 64–127 are set to "1", values of 128–191 are set to "2", and values of 192–255 are set to "3". Such conversion may be used to simplify contone data, for example, to select a number of colorant droplets to place on a print medium for each data element, and/or to identify data elements defining lighter and darker areas of an image portion. Alternatively, or in addition, data conversion may include conversion of a contone form of the image data to a bi-level halftone form of the image data. In any case, data conversion may include any suitable modification to the simplified approach presented above, for example, to reduce systematic errors in data conversion. Accordingly, an error diffusion approach (such as distribution of an error term to adjacent pixels based on the difference between a pixel's contone (or halftone) value and the threshold), random thresholding, and/or a matrix-based approach, among others, may be used to reduce errors relative to the simplified approach presented above. Other data conversion may include an adjustment in the number of data elements in the matrix (for example, by duplication or deletion of data elements). An operation of data conversion may be performed before, during, and/or after the operation of obtaining data.

Method 130 may include an operation, shown at 152, of analyzing the image data to identify data elements corresponding to lesser and greater amounts of colorant and thus corresponding to one or more lighter areas and one or more darker areas of the image portion. In the present illustration, first subset 154 of data elements (dashed hatch lines) correspond to lighter areas 155 having a lesser, nonzero amount (or density) of colorant, and second subset 156 of data elements (solid hatch lines) correspond to darker areas 157 having a greater amount (or density) of colorant. Identification of such data elements corresponding to lighter and darker areas of an image portion may be based on the data value of each data element individually and/or based on clustering of data elements having lower or higher data values. Accordingly, the analysis may be performed alternatively on a contone form 134 of the image data, a multi-level halftone form 146 of the image data, and/or on bi-level halftone data, among others. In some examples, the data values of contone data elements or multi-level halftone data elements may be compared with a predefined threshold. In the present illustration, the threshold is a halftone data value (or level) of one, so that halftone data elements having data values above one are deemed to define darker areas 157, and data elements having a data value of one are deemed to define lighter areas 155. In some examples, the threshold may be set so that the lighter areas generally can be printed in one pass without exceeding any predefined printing constraints (such as limits on nozzle firing frequency, nozzle firing rate, droplet proximities, coalescence, etc.).

Method 130 may include an operation, shown at 160, of distributing the image data to form distributed data 162 that has been apportioned to pass assignments 164, 166, 168. The operation of distributing may distribute portions 170 of the image data (and/or of individual data elements) to different pass assignments. Colorant placement defined by each data element may be assigned to a single pass assignment or to a plurality of pass assignments. Pass assignments 164, 166, 168 for portions of the image data are represented here schematically as implemented droplets 172, or masked droplets 174 for a series of overlapping pass configurations. Data corresponding to masked droplets 174 may be defined by a mask 176 and/or by an algorithm. Data elements defining lighter areas 155 of the image portion, which are more sensitive to registration errors, may be assigned for implementation in the same printhead pass, shown at 178 for pass number one, or to the same subset of printhead passes for an output swath. In contrast, data elements defining darker areas 157 of the image portion, which are less sensitive to registration errors produced between two or more passes, may be assigned to be implemented in different subsets of printhead passes (compare droplet assignment within areas 180 and 182 in pass numbers one through three).

Method 130 may include an operation, shown at 184, of placing a colorant according to distributed data 162 and thus according to pass assignments 164, 166, 168 during a plurality of printhead passes. Such pass assignments may be implemented by a single printhead performing a plurality of overlapping passes of a single printhead or by redundant printheads, each performing a single pass, among others.

It is believed that the disclosure set forth above encompasses multiple distinct embodiments of the invention. While each of these embodiments has been disclosed in specific form, the specific embodiments thereof as disclosed and illustrated herein are not to be considered in a limiting sense as numerous variations are possible. The subject matter of this disclosure thus includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

What is claimed is:

1. A method of forming images, comprising:

obtaining image data defining an image portion and including data elements defining a first subset and a second subset of areas of the image portion having one or more lesser amounts and one or more greater amounts, respectively, of a colorant; and forming the image portion by placement of the colorant onto a medium during a set of overlapping passes so that the first subset of the areas is formed by (a) a subset of the overlapping passes, (b) a predefined subset of a plurality of structures available for placing the colorant, or (c) both, wherein forming includes forming all of the first subset and the second subset of areas of the image portion with colorant droplets of about the same size.

2. The method of claim 1, wherein each data element includes a data value defining an amount of the colorant, and wherein the image data is in a contone form, the method further comprising analyzing the contone form of the image data to identify a subset of the data elements having data values corresponding to a subset of permissible values, and wherein the subset of the data elements corresponds to the first subset of the areas.

3. The method of claim 1, wherein the structures are a plurality of printheads, and wherein forming is performed so that the first subset of the areas is formed by a subset of the plurality of printheads.

4. The method of claim 1, wherein the structures are a plurality of nozzles, and wherein forming includes forming the first subset of the areas with a predefined subset of the plurality of nozzles.

5. The method of claim 1, wherein one printhead is available to place the colorant, and wherein forming includes forming the first subset of the areas with the one printhead during the subset of overlapping passes.

6. The method of claim 1, wherein obtaining includes obtaining image data corresponding to an output swath of the colorant.

7. The method of claim 1, which further comprises distributing the image data to pass assignments corresponding to the set of overlapping passes, and wherein forming includes placing the colorant during the set of overlapping passes according to the pass assignments.

8. The method of claim 7, wherein distributing includes applying one or more predefined masks to the image data.

9. The method of claim 7, wherein each data element has a data value defining an amount of the colorant, and wherein distributing includes examining the image data to identify a subset of the data elements having data values defining the one or more lesser amounts of the colorant, and wherein distributing is performed after examining.

10. The method of claim 7, wherein each data element includes a data value defining an amount of the colorant, wherein obtaining image data includes (a) obtaining a first form of the image data with data values selected from a larger set of permissible values, and (b) converting the first form to a second form of the image data having data values selected from a smaller set of permissible values, and wherein distributing is performed with the second form of the image data.

11. The method of claim 10, wherein obtaining a first form includes obtaining a contone form of the image data, wherein converting the first form to a second form includes converting the contone form to a halftone form of the image data, and wherein distributing is performed with the halftone form of the image data.

12. The method of claim 1, wherein obtaining print data includes obtaining print data in a binary halftone form.

13. A method of forming images, comprising:

obtaining image data defining an image portion and including data elements, each data element corresponding to an area of the image portion and having a data value selected from a set of three or more permissible values and corresponding to an amount of a colorant for the area, data values selected from a subset of the permissible values corresponding to a subset of the areas; and forming the image portion by placement of the colorant onto a medium during each of a set of overlapping passes so that the subset of the areas is formed by (a) a subset of the overlapping passes, (b) a predefined subset of structures available for placing the colorant, or (c) both, wherein forming includes forming all of the image portion with colorant droplets of about the same size.

14. The method of claim 13, wherein forming includes placing the colorant with at least two printheads using only one pass of each of the at least two printheads.

15. The method of claim 13, wherein forming is performed with one printhead.

16. The method of claim 13, wherein obtaining includes converting a first form of the image data having data values selected from a greater number of permissible values to a second form of the image data having data values selected from a lesser number of permissible values.

17. The method of claim 16, which further comprises distributing portions of the second form of the image data to pass assignments corresponding to the set of overlapping passes, wherein forming is performed according to the pass assignments.

18. The method of claim 13, wherein obtaining includes obtaining image data corresponding to an output swath of the colorant.

19. A method of printing with reduced registration errors, comprising:

obtaining print data defining an image portion and including data elements, the data elements defining a first subset and a second subset of the areas having one or more lesser amounts and one or more greater amounts, respectively, of a colorant; and forming the image portion by placement of the colorant onto a print medium during a set of overlapping passes of one or more printheads, so the first subset of the areas is formed by fewer of the overlapping passes than the second subset of the areas, wherein forming includes forming all of the first subset and the second subset of the areas with colorant droplets of about the same size.

20. The method of claim 19, wherein the first subset of the areas is formed by one pass of one printhead.

21. The method of claim 20, wherein the second subset of the areas is formed by colorant placement from each of a set of printheads during one pass of each printhead.

22. The method of claim 19, which further comprises analyzing the print data to identify the first and second subsets of the areas, and distributing portions of the print data to a set of pass assignments corresponding to the set of overlapping passes based on analyzing.

23. The method of claim 19, wherein the fewer passes are used to form a portion of the second subset of the areas.

24. The method of claim 19, wherein obtaining includes obtaining print data including other data elements corresponding to areas of the image portion having none of the colorant.

25. A program storage device readable by a processor, tangibly embodying a program of instructions executable by the processor to perform a method of forming images comprising:

obtaining image data defining an image portion and including data elements, the data elements corresponding to areas of the image portion and defining a first subset and a second subset of the areas having one or more lesser amounts and one or more greater amounts, respectively, of a colorant; and forming the image portion by placement of the colorant onto a medium during a set of overlapping passes so that the first subset of the areas is formed by (a) a subset of the overlapping passes, (b) a predefined subset of a plurality of structures available for placing the colorant, or (c) both, wherein forming includes forming all of the first subset and the second subset of the areas with colorant droplets of about the same size.

26. An apparatus for forming images, comprising:

a controller configured to obtain image data defining an image portion and including data elements, each data element corresponding to an area of the image portion and having a data value, the data values defining a first subset and a second subset of the areas having one or more lesser amounts and one more greater amounts, respectively, of a colorant, the controller including a data distribution mechanism configured to distribute portions of the image data to a set of pass assignments corresponding to a set of overlapping passes, so that the image portion can be formed according to the set of pass assignments by placement of the colorant onto a medium during each of the set of overlapping passes and with the first subset of the areas being formed by (a) a subset of the overlapping passes, (b) a predefined subset of structures available for placing the colorant, or (c) both, wherein forming includes forming all of the first subset and the second subset of the areas with colorant droplets of about the same size.

27. The apparatus of claim 26, wherein the data distribution mechanism is configured so that the first subset of the areas is formed by one pass.

28. The apparatus of claim 26, wherein the data distribution mechanism includes one or more predefined masks configured to create the set of pass assignments by application of the one or more predefined masks to the image data.

29. The apparatus of claim 26, further comprising a data analysis mechanism configured to identify a subset of the data elements corresponding to the first subset of the areas, wherein the data distribution mechanism is configured to create the pass assignments after operation of the data analysis mechanism.

30. A system for forming images, comprising:

a controller configured to obtain image data defining an image portion and including data elements, the data elements corresponding to areas of the image portion and defining a first subset and second subset of the areas having one or more lesser amounts and one or more greater amounts, respectively, of a colorant, the controller also being configured to distribute portions of the image data to a set of pass assignments corresponding to a set of overlapping passes, so that the first subset of the areas will be formed by a subset of the overlapping passes; and one or more image forming devices configured to perform colorant placement during each of the set of overlapping passes according to the pass assignments to form the image portion, wherein the one or more image forming devices are configured to form all of the first subset and the second subset of the areas with colorant droplets of about the same size.

31. The system of claim 30, wherein the one or more image forming devices include one or more printheads.

32. The system of claim 30, wherein the one or more image forming devices include at least two image forming devices.

33. A method of forming images, comprising:

a step for obtaining image data defining an image portion and including data elements, the data elements corresponding to areas of the image portion and defining a first subset and a second subset of the areas having one or more lesser amounts and one or more greater amounts, respectively, of a colorant; and a step for forming the image portion by placement of the colorant onto a medium during a set of overlapping passes so that the first subset of the areas is formed by at least one of (a) a subset of the overlapping passes, (b) a predefined subset of a plurality of structures available for placing the colorant, or (c) both, wherein step for forming includes forming all of the first subset and the second subset of the areas with colorant droplets of about the same size.

34. A method of forming images, comprising:

obtaining image data defining an image portion and including data elements defining a first subset and a second subset of areas of the image portion having one or more lesser amounts and one or more greater amounts, respectively, of a colorant: and forming the image portion by placement of the colorant onto a medium during a set of overlapping passes so that the first subset of the areas is formed by (a) a subset of the overlapping passes; (b) a predefined subset of a plurality of structures available for placing the colorant, or (c) both, which further comprises distributing the image data to pass assignments corresponding to the set of overlapping passes, wherein forming includes placing the colorant during the set of overlapping passes according to the pass assignments, wherein each data element includes a data value defining an amount of the colorant, wherein obtaining image data includes (a) obtaining a first form of the image data with data values selected from a larger set of permissible values, and (b) converting the first form to a second form of the image data having data values selected from a smaller set of permissible values, and wherein distributing is performed with the second form of the image data.

35. A method of forming images, comprising:

obtaining image data defining an image portion and including data elements, each data element corresponding to an area of the image portion and having a data value selected from a set of three or more permissible values and corresponding to an amount of a colorant for the area, data values selected from a subset of the permissible values corresponding to a subset of the areas; and forming the image portion by placement of the colorant onto a medium during each of a set of overlapping passes so that the subset of the areas is formed by (a) a subset of the overlapping passes, (b) a predefined subset of structures available for placing the colorant, or (c) both, wherein forming includes placing the colorant with at least two printheads using only one pass of each of the at least two printheads.

36. A method of forming images, comprising:

obtaining image data defining an image portion and including data elements, each data element corresponding to an area of the image portion and having a data value selected from a set of three or more permissible values and corresponding to an amount of a colorant for the area, data values selected from a subset of the permissible values corresponding to a subset of the areas; and forming the image portion by placement of the colorant onto a medium during each of a set of overlapping passes so that the subset of the areas is formed by (a) a subset of the overlapping passes, (b) a predefined subset of structures available for placing the colorant, or (c) both, wherein obtaining includes converting a first form of the image data having data values selected from a greater number of permissible values to a second form of the image data having data values selected from a lesser number of permissible values.

* * * * *